US006705936B2

(12) United States Patent
Wirth

(10) Patent No.: US 6,705,936 B2
(45) Date of Patent: Mar. 16, 2004

(54) LARGE-WIDTH, ANGULAR-SIDED SEGMENTAL SUPERABRASIVE GRINDING WHEEL

(75) Inventor: Jeffrey S. Wirth, Spring City, PA (US)

(73) Assignee: Wendt Dunnington Company, Royersford, PA (US)

( * ) Notice: Subject to any disclaimer, the term of this patent is extended or adjusted under 35 U.S.C. 154(b) by 40 days.

(21) Appl. No.: 09/804,747

(22) Filed: Mar. 13, 2001

(65) Prior Publication Data

US 2002/0132574 A1 Sep. 19, 2002

(51) Int. Cl.[7] ..... B23F 21/03

(52) U.S. Cl. ..... 451/541; 451/542; 451/546; 451/103

(58) Field of Search ..... 451/541, 542, 451/546, 103

(56) References Cited

U.S. PATENT DOCUMENTS

| | | | | | |
|---|---|---|---|---|---|
| 909,913 | A | | 1/1909 | Landis | |
| 2,032,362 | A | * | 3/1936 | Herman | 451/542 |
| 2,059,583 | A | | 11/1936 | Jackson et al. | |
| 2,084,513 | A | * | 6/1937 | Tone | 451/542 |
| 2,121,751 | A | * | 6/1938 | Webster | 451/546 |
| 2,178,491 | A | | 10/1939 | Palotce | |
| 2,467,878 | A | * | 4/1949 | Beth | 451/542 |
| 2,495,656 | A | * | 1/1950 | Jepson et al. | 451/542 |
| 2,724,222 | A | * | 11/1955 | Jeppson | 451/542 |
| 2,769,286 | A | * | 11/1956 | Beth | 451/542 |
| 2,810,995 | A | * | 10/1957 | Coes, Jr. et al. | 451/542 |
| 2,851,830 | A | * | 9/1958 | Metzig et al. | 451/542 |
| 3,000,149 | A | | 9/1961 | Johnson | |
| 3,324,603 | A | | 6/1967 | Niemiec | |
| 3,579,928 | A | | 5/1971 | Held | |
| 4,635,407 | A | | 1/1987 | Pacini | |
| 5,020,282 | A | | 6/1991 | Okajima et al. | |
| 5,052,154 | A | | 10/1991 | Lehmann | |
| 5,079,875 | A | * | 1/1992 | Unno et al. | 451/541 |
| D342,745 | S | | 12/1993 | Nastren et al. | |
| 5,489,235 | A | | 2/1996 | Gagliardi | |
| 5,611,724 | A | | 3/1997 | deGraaff | |
| 6,019,668 | A | * | 2/2000 | Ramanath et al. | 451/41 |
| 6,019,672 | A | | 2/2000 | Damgaard | |
| 6,129,077 | A | * | 10/2000 | Parini | 125/15 |
| 6,283,845 | B1 | * | 9/2001 | Fischbacher et al. | 451/542 |

* cited by examiner

*Primary Examiner*—Lee D. Wilson
(74) *Attorney, Agent, or Firm*—Akin Gump Strauss Hauer & Feld LLP

(57) ABSTRACT

The present invention relates to an abrading tool having a rotatable body of revolution having an axis of rotation. A peripheral workface is fixedly attached to the body of revolution. The workface is formed by a plurality of discrete, geometrically-shaped segments disposed in a contiguous relationship. Lines-of-juncture are formed by opposed edges of adjacent segments, whereby any diametrical plane, having at least one coplanar line-of-juncture, has a discontinuous coplanar curve, at least a portion thereof being the at least one coplanar line-of juncture, and whereby any longitudinal plane, having at least two coplanar lines-of-juncture, has opposed ends of the at least two coplanar lines-of-juncture being spaced apart.

6 Claims, 2 Drawing Sheets

LARGE-WIDTH, ANGULAR-SIDED SEGMENTAL SUPERABRASIVE GRINDING WHEEL

BACKGROUND OF THE INVENTION

The present invention relates to grinding wheel abrading tools, and more particularly, to large-diameter, large-width grinding wheels having a peripheral workface formed by a plurality of geometrically-shaped superabrasive plates.

Large-diameter, typically greater than ten inch, and large-width, typically greater than one and one-half inch, superabrasive grinding wheel abrading tools are commonly manufactured as either continuous-rim or segmental wheels. The superabrasive material used for the manufacture of both continuous-rim or segmental wheels is generally diamond or cubic boron nitride.

Conventional abrasives, such as aluminum oxide and silicon carbide, used as the primary abrasive in conventional grinding wheels, are also used as a secondary abrasive or filler in superabrasive grinding wheels. Conventional abrasives additionally are used for the manufacture of backing layers and as a core material for the manufacture of wheel centers in superabrasive grinding wheels.

Both continuous-rim and segmental wheels are manufactured by combining the desired abrasive materials with an organic resin binder, traditionally thermoset plastics such as phenolics and polyamides, metallic binders, traditionally comprising copper, brass, tin, silver and cast iron, and ceramic binders, typically comprising glass, clays and feldspars. The combination comprising the abrasive and the binder are formed to the desired geometry by hot pressing or cold pressing.

In hot pressing, the materials are placed in a suitable mold and simultaneously placed under pressures, typically ranging from one-thousand to ten-thousand pounds per square inch and temperatures, typically ranging from three-hundred to eighteen-hundred degrees Fahrenheit. Hot pressing is generally used to manufacture most resin and metal bonded grinding wheels as the processing temperatures are low to mid range. The molds used for resin bonding are typically aluminum or steel. The molds used for metal bonding are typically steel or graphite.

In cold pressing, the materials are placed in a suitable mold and placed under pressures, typically ranging from one-thousand to five-thousand pounds per square inch, at room temperature. The compacted material is removed from the mold and separately sintered at temperatures typically ranging from thirteen-hundred to twenty-three hundred degrees Farenheit. Cold pressing is generally used to manufacture vitrified (ceramic bonded) grinding wheels as the processing temperatures are typically destructive to common mold materials.

For the above reasons, grinding wheel manufacturers must invest in large tooling and equipment such as powerful hydraulic presses, high-temperature kilns and finishing equipment. Practical limitations regarding the equipment and the inherent problems in maintaining material consistency and dimensionality when manufacturing large molded wheels have consequently led manufacturers to fabricate composite large-diameter, large-width wheels from two or more wheels whose widths taken together equal the desired width.

The presence of seams in large-diameter, large-width superabrasive continuous-rim grinding wheel abrading tools assembled from multiple continuous-rim wheels of lesser width adversely effects the quality of the surface of a workpiece. The continuous circumferential seams between the component wheels produce grinding marks and spiral marks in the respective workpieces for plunge grinding, centerless grinding and through-feed centerless grinding applications. Attempts have been made to eliminate such grinding imperfections by having a bias angle between the component wheels, thereby creating seams that vary in location as the wheel rotates. However, the angle-biased components have not eliminated grinding imperfections. The position varying seams create areas of poor finish on the workpiece surfaces.

Segmental grinding wheels have abrading plates of superabrasive material epoxy-bonded to the circumferential surface of a wheel center or core. Traditional narrow-width segmental grinding wheel concepts typically have a single row of rectangular or parallelogram-shaped abrading plates epoxy-bonded to the circumferential surface of the wheel core. As wheel widths have increased, additional rows of abrading plates have been added to achieve a superabrasive circumferential surface of the desired width.

The presence of continuous circumferential seams between the rows of abrading plates produce grinding marks and spiral marks in the various workpieces. Attempts have been made to eliminate such grinding imperfections by staggering the alignment of the abrading plates to disrupt the continuous circumferential seams. Although staggering the alignment of the abrading plates reduces workpiece grind marks, they are not eliminated. Furthermore, the seams that are aligned parallel to the axis of wheel rotation cause harmonic vibrations in the grinding system as they are momentarily in straight-line contact with the workpiece.

A large-diameter, large-width segmental superabrasive grinding wheel abrading tool that overcomes the aforementioned limitations by having staggered abrading plates with angular sides is highly desirable as staggering the angular sided abrading plates eliminates continuous circumferential seams and line contact between the workpiece and the grinding wheel, thereby allowing a machinist to precision grind workpieces having minimal grinding imperfections.

BRIEF SUMMARY OF THE INVENTION

One aspect of the present invention relates to an abrading tool comprising a rotatable body of revolution having an axis of rotation and a peripheral workface fixedly attached to a curved surface of the body of revolution. The workface is formed by a plurality of discrete, geometrically-shaped abrading plates disposed in a generally contiguous relationship. Lines-of-juncture are formed by opposed edges of adjacent abrading plates. Any diametrical plane, having at least one coplanar line-of-juncture, has a discontinuous coplanar curve, at least a portion thereof being the at least one coplanar line-of juncture. Additionally, any longitudinal plane, having at least two coplanar lines-of-juncture, has opposed ends of the at least two coplanar lines-of-juncture being spaced apart.

Another aspect of the invention relates to an abrading tool comprising a rotatable body of revolution having an axis of rotation and a peripheral workface fixedly attached to a curved surface of the body of revolution. The workface is formed by a plurality of discrete, geometrically-shaped abrading plates disposed in a generally contiguous relationship. Lines-of-juncture are formed by opposed edges of adjacent abrading plates. All lines-of-juncture are oriented at an angle to the axis of rotation. Any diametrical plane, having at least one coplanar line-of-juncture, has a discontinuous coplanar curve, at least a portion thereof being the at least one coplanar line-of juncture.

Another aspect of the invention relates to an abrading tool comprising a rotatable body of revolution having an axis of rotation and a peripheral workface fixedly attached to a curved surface of the body of revolution. The workface is formed by a plurality of discrete, geometrically-shaped abrading plates disposed in a generally contiguous relationship. Lines-of-juncture are formed by opposed edges of adjacent abrading plates. All lines-of-juncture are oriented at a non-perpendicular angle to the axis of rotation.

Another aspect of the invention relates to an abrading plate for being attached to a curved surface of a rotatable body of revolution for the grinding of a workpiece comprising a hexagonal-shaped plate including a first mounting surface having a curvature which corresponds to the curvature of a portion of the curved surface of a rotatable body of revolution. The hexagonal-shaped plate has opposed first and fourth vertices lying in a diametrical plane of the rotatable body of revolution and radially extending side surfaces with a variable angle bevel adjacent to the first and fourth vertices. Upon orientation of the hexagonal-shaped plate such that the opposed first and fourth vertices lie in a diametrical plane of the rotatable body of revolution and upon the fixed attachment of the hexagonal-shaped plate to the curved surface of the rotatable body of revolution, a portion of a peripheral workface of an abrading tool is formed.

Still another aspect of the invention relates to an abrading plate for being attached to a curved surface of a rotatable body of revolution for the grinding of a workpiece comprising a parallelogram-shaped plate including a first mounting surface having a curvature which corresponds to the curvature of a portion of the curved surface of a rotatable body of revolution. The parallelogram-shaped plate has parallel first and third radially extending side surfaces with a variable bevel angle. Upon orientation of the parallelogram-shaped plate such that the first and third radially extending side surfaces intersect at an angle with a diametrical plane of the rotatable body of revolution and upon the fixed attachment of the parallelogram-shaped plate to the curved surface of the rotatable body of revolution, a portion of a peripheral workface of an abrading tool is formed.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
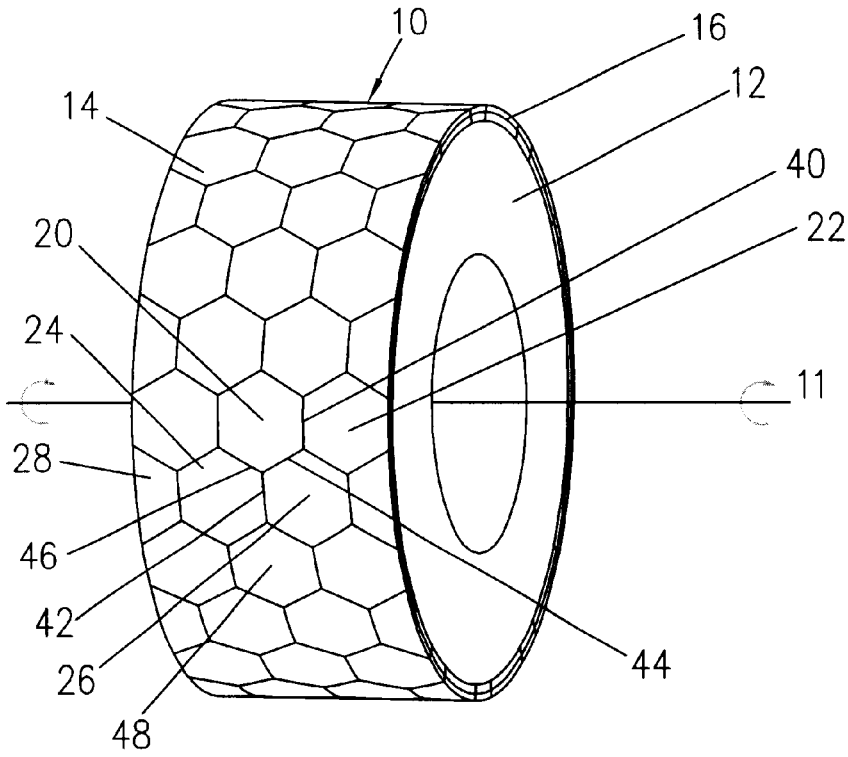
FIG. 1 is a perspective view of a first preferred embodiment of an abrading tool in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the large-width, angular-sided segmental superabrasive grinding wheel abrading tool and designated parts thereof. The terminology includes the words above specifically mentioned, derivatives thereof and words of similar import.

Additionally, as used in the following description, the words "longitudinal plane" refer to any plane parallel to an axis of rotation of a body of revolution or including the axis of rotation of the body of revolution in its entirety. The words "diametrical plane" refer to any plane perpendicular to an axis of rotation of a body of revolution. The words "unit surface normal vector" refer to a vector perpendicular to a plane tangent to a point on a curved surface.

Referring to the drawings in detail, where like numerals indicate like elements throughout there is shown in FIGS. 1–4 a first preferred embodiment of the abrading tool, generally designated 10, and hereinafter referred to as the "hexagonal abrading tool" 10, in accordance with the present invention. The hexagonal abrading tool 10 has a rotatable body of revolution 12 having an axis of rotation 11. In the first preferred embodiment, the rotatable body of revolution 12 is a generally circular cylinder having a generally annular cross section. However, those of ordinary skill in the abrading tool art will understand from the present disclosure that the invention is not limited to bodies of revolution that are circular cylinders and that the rotatable body of revolution 12 could have other shapes such as a cone, paraboloid, ellipsoid, or the like. The rotatable body of revolution 12 is suitable for coupling the hexagonal abrading tool 10 to a shaft (not shown) for rotating the hexagonal abrading tool 10 about the axis of rotation 11 of the hexagonal abrading tool 10 in one of numerous well-known manners in the abrading tool art, such as by clamping the rotatable body of revolution 12 between annular end-plates (not shown) removably attached to a shaft (not shown).

A peripheral workface 14 is fixedly attached to a generally curved surface 16 of the rotatable body of revolution 12. The peripheral workface 14 is formed from a plurality of discrete, geometrically-shaped abrading plates disposed in a generally contiguous relationship. In the first preferred embodiment, the geometrically-shaped abrading plates are hexagonal-shaped plates.

Figure 2:
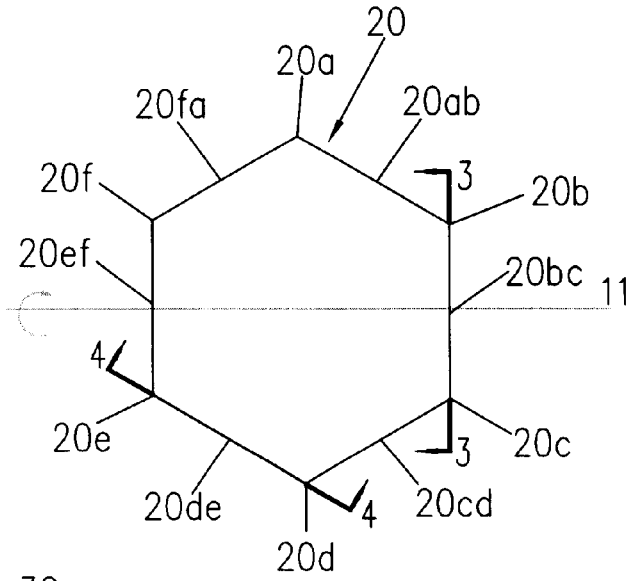
FIG. 2 is an enlarged top plan view of one of the abrading plates of the abrading tool shown in FIG. 1.
Figure 3:
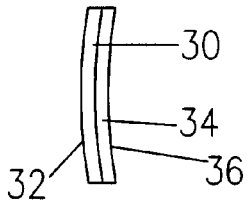
FIG. 3 is a side elevation view of the abrading plate of FIG. 2 taken along line 3—3 of FIG. 2.
Figure 4:
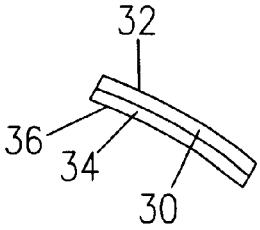
FIG. 4 is a side elevation view of the abrading plate of FIG. 2 taken along line 4—4 of FIG. 2.

Referring to FIGS. 2–4, there is shown a first hexagonal-shaped plate 20, representative of the plurality of geometrically-shaped abrading plates. The fixed attachment of the hexagonal-shaped plate 20 to the rotatable body of revolution 12 forms a portion of the peripheral workface 14 of the rotatable body of revolution 12. The first hexagonal-shaped plate 20 has a first mounting surface 36 having a radius of curvature that generally corresponds to the radius of curvature of the curved surface 16 of the rotatable body of revolution 12. The first hexagonal-shaped plate 20 has an impregnation layer 30 having a peripheral abrasive work surface 32. The impregnation layer 30 preferably includes an abrasive grind such as the superabrasives diamond or cubic boron nitride and a binder such as an organic resin binder, a metallic binder or a ceramic binder. Those of ordinary skill in the abrading tool art will understand from the present disclosure that the abrasive grind is not limited to superabrasives and that the abrasive grind could be any abrading material. The artisan will further understand that the binder is not limited to a particular organic resin binder, metallic binder or ceramic binder and that the binder could be any material that binds the abrasive grind.

The first hexagonal-shaped plate 20 additionally has a backing layer 34 disposed in a contiguous relationship with the impregnation layer 30. The backing layer 34 includes the first mounting surface 36. The backing layer 34 preferably comprises a conventional abrasive grind such as aluminum oxide or silicon carbide. Those of ordinary skill in the abrading tool art will understand from the present disclosure that the backing layer 34 could be formed from materials other than a conventional abrasive and that the backing layer 34 is not required. All that is required is that the first hexagonal-shaped plate 20 have an impregnation layer 30 having a peripheral abrasive work surface 32 and a first mounting surface 36.

Referring to FIG. 2, the first hexagonal-shaped plate 20 has first through sixth vertices 20*a*–20*f*, respectively, and first through sixth radially extending side surfaces 20*ab*, 20*fa*, respectively. The two letter subscripts designate the vertices between which a radially extending side surface lies. For example, the first radially extending side surface 20*ab* lies between the first vertex 20*a* and the second vertex 20*b* of the first hexagonal-shaped plate 20.

The first vertex 20*a* and the fourth vertex 20*d* of the hexagonal-shaped plate 20 oppose each other and lie in a diametrical plane of the rotatable body of revolution 12. The second radially extending side surface 20*bc* and the fifth radially extending side surface 20*ef* of the hexagonal-shaped plate 20 oppose each other and lie in parallel spaced apart diametrical planes of the rotatable body of revolution 12.

The first and sixth radially extending side surfaces 20*ab*, 20*fa* of the hexagonal-shaped plate 20 are adjacent to the first vertex 20*a*, and have a variable angle bevel such that a unit surface normal vector originating at any point on the first and sixth radially extending side surfaces 20*ab*, 20*fa* is perpendicular to a radial line extending from the axis of rotation of the rotatable body of revolution 12 to the point of origin of the unit surface normal vector and, additionally, is oriented at an angle of approximately sixty degrees to the diametrical plane in which the radial line lies.

Similarly, the third and fourth radially extending side surfaces 20*cd*, 20*de* of the hexagonal-shaped plate 20 are adjacent to the fourth vertex 20*d* and have a variable angle bevel such that a unit surface normal vector originating at any point on the first and sixth radially extending side surfaces 20*cd*, 20*de* is perpendicular to a radial line extending from the axis of rotation of the rotatable body of revolution 12 to the point of origin of the unit surface normal vector and, additionally, is oriented at an angle of approximately sixty degrees to the diametrical plane in which the radial line lies.

Those of ordinary skill in the abrading art will understand from the present disclosure that the angle that the unit surface normal vector makes with respect to the diametrical plane in which the radial line lies depends upon the geometrical shape of the abrading plates forming the workface 14.

Referring to FIG. 1, there is shown a representative portion of the workface 14 formed by the first hexagonal-shaped plate 20 arranged in a contiguous relationship with second, third, and fourth hexagonal-shaped plates 22, 24, 26, each of which is substantially similar to the first hexagonal-shaped plate 20 in features and orientation. Accordingly, the same nomenclature discussed above for the first hexagonal-shaped plate 20 will be used for the second, third and fourth hexagonal-shaped plates 22, 24, 26.

The second, third and fourth hexagonal-shaped plates 22, 24, 26 have first through sixth vertices and first through sixth radially extending side surfaces respectively corresponding to the first through sixth vertices 20*a*–20*f* and the first through sixth radially extending side surfaces 20*ab*–20*fa* of the first hexagonal-shaped plate 20. The second, third and fourth hexagonal-shaped plates 22, 24, 26 are oriented similar to the first hexagonal-shaped plate 20 and have second and fifth radially extending side surfaces that lie in parallel spaced apart diametrical planes. The first, third, fourth and sixth radially extending side surfaces of the second, third and fourth hexagonal-shaped plates 22, 24, 26 have variable angle bevels similar to the bevel of the corresponding side surfaces of the first hexagonal-shaped plate 20.

The abrading tool artisan will understand from the present disclosure that the peripheral workface 14 will include partial hexagonal-shaped abrading plates, such as the partial hexagonal-shaped plate 28 formed by the bisection of a hexagonal-shaped abrading plate along a line extending from the first vertex to the fourth vertex to permit the formation of a contiguous peripheral workface 14 extending to the edge of the rotatable body of revolution 12.

Lines-of-juncture are formed by the opposed edges of the adjacent abrading plates forming the peripheral workface 14. More specifically, referring to FIG. 1, in a first preferred embodiment of the hexagonal abrading tool 10, a first line-of-juncture 40 is formed by the opposed second and fifth radially extending side surfaces of the first and second hexagonal-shaped plates 20, 22, respectively. A second line-of-juncture 42 is formed by the opposed second and fifth radially extending side surfaces of the third and fourth hexagonal-shaped plates 24, 26, respectively. A third line-of-juncture 44 is formed by the opposed third and sixth radially extending side surfaces of the first and fourth hexagonal-shaped plates 20, 26, respectively. A fourth line-of-juncture 46 is formed by the opposed fourth and first radially extending side surfaces of the first and third hexagonal-shaped plates 20, 24, respectively. The first and second lines-of-juncture 40, 42 lie in spaced apart diametrical planes. The third and fourth lines-of-juncture 44, 46 are oriented at an angle with respect to the axis of rotation of the rotatable body of revolution 12.

Those skilled in the abrading tool art will understand from the above arrangement of the first, second, third and fourth hexagonal-shaped plates 20, 22, 24, 26 and the first, second, third and fourth lines-of juncture 40, 42, 44, 46 that the abrading plates comprising the peripheral workface 14 are staggered and that any diametrical plane of the rotatable body of revolution 12, having at least one coplanar line-of-juncture, also has a discontinuous coplanar curve, at least a portion thereof being the at least one coplanar line-of-juncture. In other words, the abrading plates are positioned on the peripheral workface 14 such that a diametrical plane, arbitrarily positioned along the axis of rotation 11, may or may not necessarily entirely include one or more lines-of-juncture. However, if the arbitrarily positioned diametrical plane does entirely include one or more lines-of-juncture, no continuous curve circumscribing the peripheral workface 14 can be constructed from the lines-of-juncture. For example, referring to FIG. 1, although the first line-of-juncture 40 and a fifth line-of-junction 48 lie entirely in a first diametrical plane (not shown), the first and fifth lines-of-juncture are separated by the fourth hexagonal-shaped plate 46. Consequently, a continuous curve circumscribing the peripheral workface 14 can not be constructed from the lines-of-juncture that lie in the first diametrical plane.

Additionally, the abrading tool artisan will understand that preferably all lines-of-juncture are oriented at an angle to the axis of rotation 11 of the rotatable body of revolution 12. In other words, preferably, no line-of-juncture lies entirely in a longitudinal plane. For example, referring to FIG. 1, all the abrading plates comprising the peripheral workface 14 are generally hexagonal-shaped and have first and fourth vertices that lie in diametrical planes, second and fifth radially extending side surfaces that are perpendicular to the axis of rotation 11 and first, third, fourth and sixth radially extending side surfaces that are oriented at an angle to the axis of rotation 11. The abrading tool artisan also will understand that other geometrically-shaped abrading plates, such as diamond-shaped plates could comprise the workface 14, thereby forming a workface 14 having all lines-of-juncture oriented at a non-perpendicular angle to the axis of rotation 11.

Further, without departing from the spirit and scope of the present invention, the abrading tool artisan will understand that a line-of-junction may lie in a longitudinal plane provided that any longitudinal plane having at least two coplanar lines of juncture has opposed ends of the at least two coplanar lines-of-juncture being spaced apart. In other words, the abrading plates are positioned on the peripheral workface 14 such that an arbitrarily positioned longitudinal plane intersecting the peripheral workface 14 could but may not necessarily include in its entirety at least two lines-of-juncture. However, if the arbitrarily positioned longitudinal plane does entirely include two or more lines-of-juncture, no continuous line spanning the longitudinal extent of the workface 14 can be constructed from the lines-of-juncture.

Referring to FIGS. 5–8, there is shown a second preferred embodiment of the abrading tool, generally designated 110, and hereinafter referred to as the "parallelogram abrading tool" 110, in accordance with the present invention. The parallelogram abrading tool 110 has a rotatable body of revolution 112 having an axis of rotation 111 and a shape in the form of a generally circular cylinder having a generally annular cross section. The rotatable body of revolution 112 is suitable for coupling the parallelogram abrading tool 110 to a shaft (not shown) for rotating the parallelogram abrading tool 110 about the axis of rotation 111 of the rotatable body of revolution 112.

A peripheral workface 114 is fixedly attached to a curved surface 116 of the rotatable body of revolution 112. The peripheral workface 114 is formed from a plurality of discrete, parallelogram-shaped abrading plates disposed in a contiguous relationship.

Figure 6:
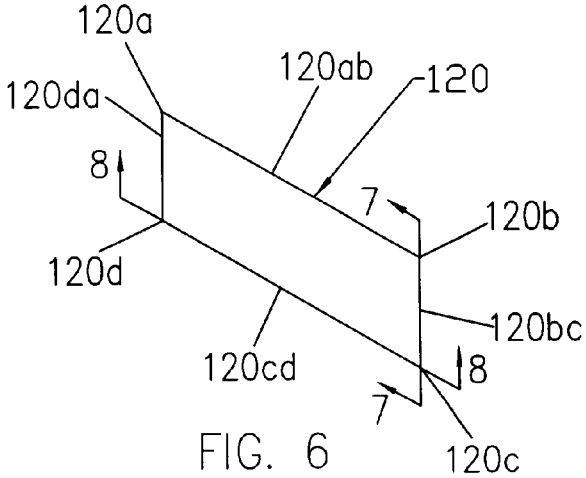
FIG. 6 is an enlarged top plan view of one of the abrading plates of the abrading tool shown in FIG. 5.
Figure 7:
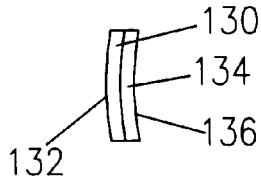
FIG. 7 is a side elevation view of the abrading plate of FIG. 6 taken along line 7—7 of FIG. 6.
Figure 8:
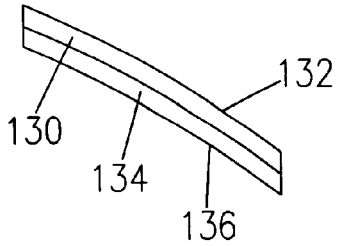
FIG. 8 is a side elevation view of the abrading plate of FIG. 6 taken along line 8—8 of FIG. 6.

Referring to FIGS. 6–8, there is shown a first generally parallelogram-shaped plate 120, representative of the plurality of parallelogram-shaped abrading plates. The fixed attachment of the parallelogram-shaped plate 120 to the rotatable body of revolution 112 forms a portion of the peripheral workface 114 of the rotatable body of revolution 112. The first parallelogram-shaped plate 120 has a first mounting surface 136 having a radius of curvature that generally corresponds to the radius of curvature of the curved surface 116 of the rotatable body of revolution 112. The first parallelogram-shaped plate 120 has an impregnation layer 130 having a peripheral abrasive work surface 132. The impregnation layer 130 preferably includes an abrasive grind such as the superabrasives diamond or cubic boron nitride and a binder such as an organic resin binder, a metallic binder or a ceramic binder. Those of ordinary skill in the abrading tool art will understand from the present disclosure that the abrasive grind is not limited to superabrasives and that the abrasive grind could be any abrading material. The artisan will further understand that the binder is not limited to a particular organic resin binder, metallic binder or ceramic binder and that the binder could be any material that binds the abrasive grind.

The first parallelogram-shaped plate 120 additionally has a backing layer 134 disposed in a contiguous relationship with the impregnation layer 130. The backing layer 134 includes the first mounting surface 136. The backing layer 134 preferably comprises a conventional abrasive such as aluminum oxide or silicon carbide. Those of ordinary skill in the abrading tool art will understand from the present disclosure that the backing layer 134 could be formed from materials other than a conventional abrasive and that the backing layer 134 is not required. All that is required is that the first parallelogram-shaped plate 120 have an impregnation layer 130 having a peripheral abrasive work surface 132 and a first mounting surface 136.

Referring to FIG. 6, the first parallelogram-shaped plate 120 has first through fourth vertices 120*a*–120*d*, respectively, and first through fourth radially extending side surfaces 120*ab*–120*da*, respectively. The second radially extending side surface 120*bc* and the fourth radially extending side surface 120*da* of the parallelogram-shaped plate 120 oppose each other and lie in parallel spaced apart diametrical planes of the rotatable body of revolution 112. The first and third radially extending side surfaces 120*ab*, 120*cd* of the parallelogram-shaped plate 120 intersect at an angle with a diametrical plane of the rotatable body of revolution 112 and have a variable angle bevel such that a unit surface normal vector originating at any point on the first and third radially extending side surfaces 120*ab*, 120*cd* is perpendicular to a radial line extending from the axis of rotation of the rotatable body of revolution 112 to the point of origin of the unit surface normal vector. Those of ordinary skill in the abrading art will understand from the present disclosure that the angle that the unit surface normal vector makes with respect to the diametrical plane in which the radial line lies depends upon the included angle between the first and fourth radially extending side surfaces 120*ab*, 120*da* of the parallelogram-shaped plate 120.

Figure 5:
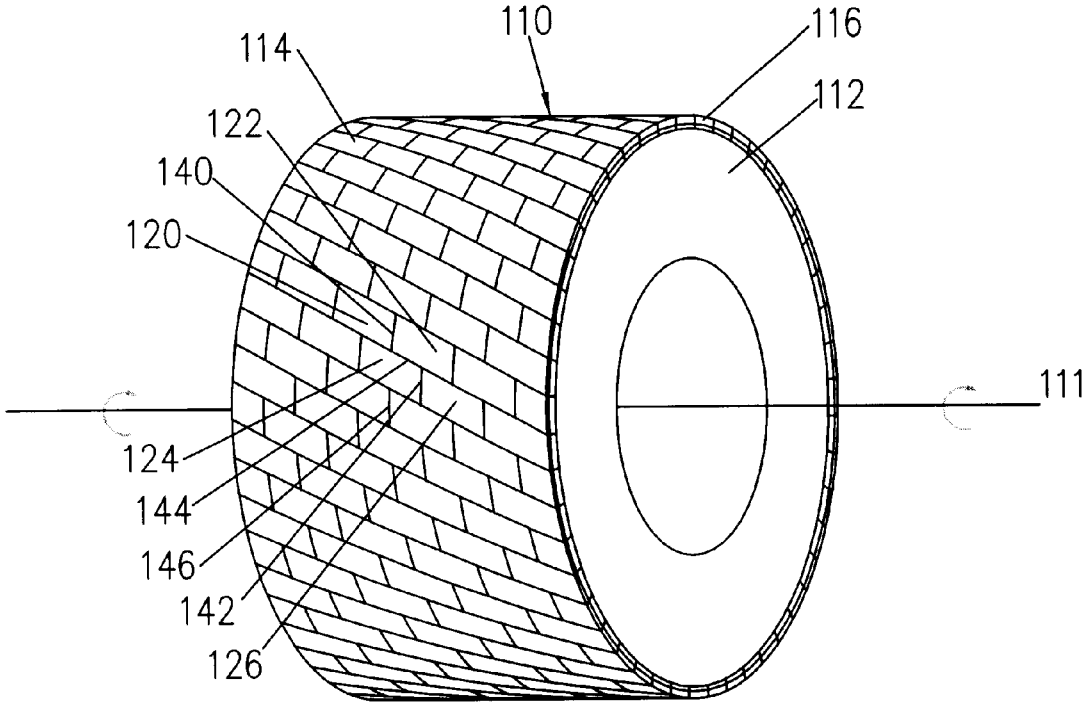
FIG. 5 is a perspective view of a second preferred embodiment of an abrading tool in accordance with the present invention.

Referring to FIG. 5, there is shown a representative portion of the workface 114 formed by the first parallelogram-shaped plate 120 arranged in a contiguous relationship with second, third, and fourth parallelogram-shaped plates 122, 124, 126, each of which is substantially similar to the first parallelogram-shaped plate 120 in features and orientation. Accordingly, the same nomenclature discussed above for the first parallelogram-shaped plate 120 will be used for the second, third and fourth parallelogram-shaped plates 122, 124, 126.

The second, third and fourth parallelogram-shaped plates 122, 124, 126 have first through fourth vertices and first through fourth radially extending side surfaces respectively corresponding to the first through fourth vertices 120*a*–120*d* and the first through fourth radially extending side surfaces 120*ab*–120*da* of the first parallelogram-shaped plate 120. The second, third and fourth parallelogram-shaped plates 122, 124, 126 are oriented similar to the first parallelogram-shaped plate 120 and have second and fourth radially extending side surfaces that lie in parallel spaced apart diametrical planes. The first and third radially extending side surfaces of the second, third and fourth parallelogram-shaped plates 122, 124, 126 have variable angle bevels similar to the bevel of the corresponding side surfaces of the first parallelogram-shaped plate 120.

A first line-of-juncture 140 is formed by the opposed second and fourth radially extending side surfaces of the first and second parallelogram-shaped plates 120, 122, respectively. A second line-of-juncture 142 is formed by the opposed second and fourth radially extending side surfaces of the third and fourth parallelogram-shaped plates 124, 126 respectively. A third line-of-juncture 144 is formed by the first radially extending side surface of the third parallelogram-shaped plate 124 and a portion of the third radially extending side surface of the first and second parallelogram-shaped plates 120, 122. The first and second lines-of-juncture 140, 142 lie in spaced apart diametrical planes. The third line-of-juncture 144 is oriented at an angle with respect to the axis of rotation of the rotatable body of revolution 112.

Those skilled in the abrading tool art will understand from the above arrangement of the first, second, third and fourth parallelogram-shaped plates 120, 122, 124, 126 and the first, second, and third lines-of juncture 140, 142, 144 that the parallelogram-shaped plates comprising the peripheral workface 114 are staggered and angled with respect to the axis of rotation 111 of the body of revolution 112. Those skilled in the art also will understand that any diametrical plane of the rotatable body of revolution 112, having at least one coplanar line-of-juncture, also has a discontinuous coplanar curve, at least a portion thereof being the at least one coplanar line-of-juncture. In other words, the abrading plates are positioned on the peripheral workface 114 such that a diametrical plane, arbitrarily positioned along the axis of rotation 111, may or may not necessarily entirely include one or more lines-of-juncture. However, if the arbitrarily positioned diametrical plane does entirely include one or more lines-of-juncture, no continuous curve circumscribing the peripheral workface 114 can be constructed from the lines-of-juncture. For example, referring to FIG. 5, although the first line-of-juncture 140 and a fourth line-of-junction 146 lie entirely in a second diametrical plane (not shown), the first and fourth lines-of-juncture are separated by the third parallelogram-shaped plate 124. Consequently, a continuous curve circumscribing the peripheral workface 114 can not be constructed from the lines-of-juncture that lie in the second diametrical plane. Additionally, the artisan will understand that no line-of-juncture lies in a longitudinal plane.

From the present disclosure, those skilled in the abrading tool art will understand that the invention is not limited to abrading plates that are hexagonal or parallelogram in shape and that any geometrically-shaped abrading plate may be used. The only requirement is that the geometrically-shaped abrading plates are disposed in a generally contiguous relationship to form the peripheral workface 14, 114 of the rotatable body of revolution 12, 112 and that any diametrical plane, having at least one coplanar line-of juncture formed by opposed radially extending side surfaces of adjacent abrading plates, has a discontinuous coplanar curve, at least a portion thereof being the at least one coplanar line-of juncture, and any longitudinal plane, having two or more coplanar lines-of-juncture, has opposed ends of the at least two or more coplanar lines-of-juncture being spaced apart.

In use, the hexagonal and parallelogram abrading tools 10, 110 of the present disclosure are coupled to a drive shaft (not shown) of grinding machines (not shown), such as a plunge grinding, centerless grinding and through-feed centerless grinding machine, in a manner well-known in the abrading tool art. The abrading of a work piece proceeds in a manner also well-known in the abrading tool art.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An abrading tool comprising:

a rotatable body of revolution having an axis of rotation; and a peripheral workface fixedly attached to a curved surface of the body of revolution, the workface being formed by a plurality of discrete, geometrically-shaped abrading plates, the abrading plates being disposed in a generally contiguous relationship with lines-of-juncture being formed by opposed edges of adjacent abrading plates, the lines-of-juncture oriented at an angle to the axis of rotation.

2. The abrading tool according to claim 1, wherein the body of revolution is a circular cylinder and the geometrically-shaped abrading plates include an impregnation layer having a peripheral abrasive work surface and a backing layer disposed in a contiguous relationship with the impregnation layer.

3. An abrading tool comprising:

a rotatable body of revolution having an axis of rotation; and a peripheral workface fixedly attached to a curved surface of the body of revolution, the workface being formed by a plurality of discrete, geometrically-shaped abrading plates, the abrading plates being disposed in a generally contiguous relationship with lines-of-juncture being formed by opposed edges of adjacent abrading plates, the lines-of-juncture oriented at an angle to the axis of rotation, wherein the body of revolution is a circular cylinder and the geometrically-shaped abrading plates include an impregnation layer having a peripheral abrasive work surface and a backing layer disposed in a contiguous relationship with the impregnation layer, and wherein the geometrically-shaped abrading plates are one of a hexagon having opposed first and fourth vertices lying in a diametrical plane of the rotatable body of revolution and radially extending side surfaces with a variable angle bevel adjacent to the first and fourth vertices and the hexagon bisected along a line extending from the first vertex to the fourth vertex.

4. An abrading plate for being attached to a curved surface of a rotatable body of revolution for the grinding of a workpiece comprising: a hexagonal-shaped plate including a first mounting surface having a curvature which corresponds to the curvature of a portion of the curved surface of a rotatable body of revolution, the plate having opposed first and fourth vertices and radially extending side surfaces with a variable angle bevel adjacent to the first and fourth vertices, whereby upon orientation of the hexagonal-shaped plate such that the opposed first and fourth vertices lie in a diametrical plane of the rotatable body of revolution and upon the fixed attachment of the hexagonal-shaped plate to the curved surface of the rotatable body of revolution, a portion of a peripheral workface of an abrading tool is formed.

5. The abrading plate according to claim 4, wherein the hexagonal-shaped plate includes an impregnation layer having a peripheral abrasive work surface and a backing layer disposed in a contiguous relationship with the impregnation layer, the backing layer having a surface corresponding to the first mounting surface.

6. The abrading plate according to claim 5, wherein the impregnation layer comprises a superabrasive material and the backing layer comprises a conventional abrasive material.

* * * * *